US010806014B2

(12) United States Patent
Rogers et al.

(10) Patent No.: US 10,806,014 B2
(45) Date of Patent: Oct. 13, 2020

(54) X-RAY TUBE CASING WITH INTEGRAL HEAT EXCHANGER

(71) Applicant: GE Precision Healthcare LLC, Wauwatosa, WI (US)

(72) Inventors: Carey S. Rogers, Waukesha, OH (US); Anup G. Nair, Karnataka (IN); Andrew J Desrosiers, Cincinnati, OH (US); Sid Raje, Cincinnati, OH (US); Cassidy C. Shibiya, Harrison, OH (US)

(73) Assignee: GE Precision Healthcare LLC, Wauwatosa, WI (US)

( * ) Notice: Subject to any disclaimer, the term of this patent is extended or adjusted under 35 U.S.C. 154(b) by 0 days.

(21) Appl. No.: 16/442,909

(22) Filed: Jun. 17, 2019

(65) Prior Publication Data

US 2019/0306964 A1 Oct. 3, 2019

Related U.S. Application Data

(63) Continuation-in-part of application No. 15/630,409, filed on Jun. 22, 2017, now Pat. No. 10,512,146.

(51) Int. Cl.

| | |
|---|---|
| ***H01J 35/00*** | (2006.01) |
| ***H05G 1/02*** | (2006.01) |
| ***H01J 5/02*** | (2006.01) |
| ***H01J 35/06*** | (2006.01) |
| ***H01J 35/16*** | (2006.01) |

(Continued)

(52) U.S. Cl.

CPC ..... *H05G 1/025* (2013.01); *F04D 25/00* (2013.01); *F04D 29/58* (2013.01); *H01J 5/02* (2013.01); *H01J 35/065* (2013.01); *H01J 35/16* (2013.01); *H01J 35/24* (2013.01); *H05G 1/04* (2013.01); *H01J 2235/12* (2013.01)

(58) Field of Classification Search

CPC ..... H05G 1/025; H01J 5/02; H01J 35/065; H01J 35/16; H01J 35/24; H01J 2235/12; H06G 1/04; F04D 29/58

See application file for complete search history.

(56) References Cited

U.S. PATENT DOCUMENTS

| | | | |
|---|---|---|---|
| 7,280,638 | B1 | 10/2007 | Weaver et al. |
| 9,648,710 | B2 | 5/2017 | Smith et al. |

(Continued)

FOREIGN PATENT DOCUMENTS

| | | |
|---|---|---|
| JP | S58-30054 | 2/1983 |
| JP | 2001223097 | 8/2001 |

OTHER PUBLICATIONS

EP Application No. 18178600.5, European Extended Search Report dated Apr. 15, 2019, 14 pages (Continued)

*Primary Examiner* — Kiho Kim

(57) ABSTRACT

An x-ray tube casing is provided which includes a housing having a heat exchanger integrally formed thereon in an additive manufacturing process. The additive manufacturing process allows for tight tolerances with regard to the structure for the casing and the internal passages of the heat exchanger to significantly reduce the size and weight of the casing. The casing additionally includes a fluid distribution manifold that effectively distributes the cooling fluid within the casing to more efficiently provide cooling to the x-ray tube insert disposed within the casing.

21 Claims, 10 Drawing Sheets

(51) Int. Cl.

| | |
|---|---|
| ***H05G 1/04*** | (2006.01) |
| ***F04D 25/00*** | (2006.01) |
| ***F04D 29/58*** | (2006.01) |
| ***H01J 35/24*** | (2006.01) |

(56) References Cited

U.S. PATENT DOCUMENTS

| | | | | |
|---|---|---|---|---|
| 2004/0202282 | A1 | 10/2004 | Miller | |
| 2004/0234041 | A1 | 11/2004 | Artig et al. | |
| 2006/0146985 | A1 | 7/2006 | Deutscher et al. | |
| 2007/0098144 | A1* | 5/2007 | Zhang | F04D 29/541 378/200 |
| 2008/0043919 | A1 | 2/2008 | Chapin et al. | |
| 2015/0103978 | A1* | 4/2015 | Chan | H01J 35/105 378/129 |
| 2015/0139406 | A1 | 5/2015 | Hansen et al. | |
| 2016/0029468 | A1* | 1/2016 | Anno | H05G 1/025 378/130 |
| 2017/0018393 | A1 | 1/2017 | Kuth et al. | |
| 2017/0209954 | A1* | 7/2017 | Kato | C22C 30/00 |

OTHER PUBLICATIONS

EP Application No. 18178600.5, Partial Search Report and Opinion dated Nov. 27, 2018, 16 pages.

* cited by examiner

X-RAY TUBE CASING WITH INTEGRAL HEAT EXCHANGER

CROSS-REFERENCE TO RELATED APPLICATIONS

This application claims priority as a continuation-in-part of co-owned and co-pending U.S. Non-Provisional Patent Application Ser. No. 15/630,409, entitled X-Ray Tube Casing, filed on Jun. 22, 2017, the entirety of which is expressly incorporated herein by reference for all purposes.

FIELD AND BACKGROUND OF THE DISCLOSURE

The invention relates generally to x-ray tubes, and more particularly to a casing for enclosing the various components of the x-ray tube.

X-ray systems may include an x-ray tube, a detector, and a support structure for the x-ray tube and the detector. In operation, an imaging table, on which an object is positioned, may be located between the x-ray tube and the detector. The x-ray tube typically emits radiation, such as x-rays, toward the object. The radiation passes through the object on the imaging table and impinges on the detector. As radiation passes through the object, internal structures of the object cause spatial variances in the radiation received at the detector. The detector then transmits data received, and the system translates the radiation variances into an image, which may be used to evaluate the internal structure of the object. The object may include, but is not limited to, a patient in a medical imaging procedure and an inanimate object as in, for instance, a package in an x-ray scanner or computed tomography (CT) package scanner.

The X-ray tube includes an x-ray tube insert and an x-ray tube casing. The x-ray tube insert is the functional device that generates x-rays, while the x-ray tube casing is a housing that surrounds, protects and supports the insert. The x-ray tube casing performs the following functions:

physically supporting the x-ray tube insert inside the x-ray tube casing so that an x-ray transmissive window on the x-ray tube insert is held in a position registered to the x-ray transmissive window in the x-ray tube casing, enabling x-rays produced within the x-ray tube insert to exit the x-ray tube assembly and illuminate the object of interest;

shielding of x-rays emanating from the x-ray tube insert except for a defined portion that pass through x-ray transmissive window(s) toward the object of interest;

supporting the motor stator relative to the motor rotor fur a rotating anode x-ray tube;

providing for high-voltage electrical connections between the x-ray tube insert and the high voltage generator, which are typically made via high voltage plug and socket or via a high voltage connector being removably secured to a high voltage insulator with a silicone gasket in-between;

hermetically enclosing and directing a coolant within the x-ray tube casing around the x-ray tube insert—the vacuum vessel of the x-ray tube insert gets very hot when operated and that heat is removed by circulating a dielectric oil, or other suitable coolant, over the x-ray tube insert vacuum vessel that is subsequently pumped to an external heat exchanger where the heat is rejected to the room air or to another liquid coolant before being returned to the x-ray tube casing; and operably connecting the x-ray tube insert to the imaging system gantry or positioner.

Looking at FIGS. 1 and 2, an x-ray tube insert 14' is disposed within a conventional x-ray tube casing 10'. The casing 10' includes a housing 12', an end cap 15' secured to the housing 12' at one end and a cover plate 16' secured to the housing 12' opposite the end cap 15'. The housing 12' is formed of a mid casing 18' within which the x-ray tube insert 14' is disposed. The housing 12' additionally includes an end casing 21' connected to one end of the mid casing 18' which encloses the shaft and bearing assembly of the x-ray source 14'.

The housing 12', e.g., the mid casing 18' and the end casing 21' are typically fabricated by a casting technique, machined from bulk material, or fabricated from separately formed pieces that are joined together by welding and/or brazing processes. The mid casing 18' and end casing 21' are subsequently joined to one another to enclose the x-ray tube insert 14' positioned therein.

Looking now at FIGS. 1 and 2, the x-ray tube casing 10' includes a heat exchanger 24' as part of a cooling circuit 25' utilizing a cooling system disposed externally of the housing 12' and including a water chiller/reservoir 27' and pump 29' circulating cooled water through a dedicated oil to water heat exchanger 24' to thermally contact and cool the dielectric tube oil 26' contained within the casing 10' and pumped through the opposing side of the heat exchanger 24'. The oil 26' passes through an oil filter 28' that preserves the electrically insulating properties of the dielectric oil 26'. As schematically shown in FIG. 2, the oil 26' is present within the casing 10' to support the x-ray tube insert 14' within the casing 10' and to provide heat removal from the insert 14'.

While sufficient to cool the oil 26' from within the casing 10', the dedicated oil-water heat exchanger 24' and associated cooling circuit 25' including the tubes or lines directing the various fluids between the housing 12' and the heat exchanger 24' creates added cost and weight and size to the x-ray tube casing 10'. Further, the size of the tube casing 10', including the heat exchanger 24'/cooling circuit 25' connected and/or mounted to the exterior of the casing 10', significantly increases the overall size and weight of the casing 10', limiting the degree of oblique imaging angles around the patient that can be utilized and compromising the quality of exam performed.

One attempt to overcome the issues regarding the external heat exchange circuit 25 is disclosed in co-pending and co-owned U.S. Patent Application Publication No. US2013/0376574 entitled X-Ray Tube Casing, which is expressly incorporated herein by reference in its entirety. In this reference, the x-ray tube casing is formed in an additive manufacturing manner that forms fluid passages directly within the casing for countercurrent flows of dielectric oil and a cooling fluid in order to provide the heat exchange between the fluids to cool the x-ray tube insert.

However, as the disclosed x-ray tube casing still employs a number of heat exchange circuit components externally of the casing, among other issues, it is desirable to develop a structure, method of manufacture and method for use of an improved x-ray tube casing that is designed to reduce the weight of the casing while improving the cooling capacity of the casing when in use.

BRIEF DESCRIPTION OF THE DISCLOSURE

In the invention, an x-ray tube casing provides x-ray insert cooling and mechanical support without the need for a separate external cooling circuit. The casing is formed from a metal in a suitable additive manufacturing process. The casing is formed to include walls having integral internal passages therein to supply a cooling fluid directly to and through the casing body without the need for an external cooling circuit and/or separate component heat exchanger.

According to one aspect of an exemplary embodiment of the invention, the x-ray tube casing is manufactured using a metal material to form the structural walls of the housing to be continuous throughout the casing structure. This integral nature of the material forming the casing eliminates leaks that often occur at joints between component parts of prior art casings where separate components are joined or secured to one another. The wall thickness of the casing can be varied during manufacture in accordance with the structural strength needed at any particular location. This optimization provides the necessary amount of material at different locations in the casing while minimizing the overall mass of the casing.

According to another aspect of an exemplary embodiment of the invention, the construction of the casing with cooling channels embedded within the casing provides the casing with the capability to direct chilled coolant through the casing and provide more effective heat exchange as a result of the large surface area of the casing that is in direct thermal contact with the dielectric oil flowing between the insert and the casing.

According to still a further aspect of an exemplary embodiment of the invention, ability to manufacture the casing with close tolerances enable the formation of a casing that conforms closely to the shape of the x-ray tube insert. This enables a reduction in the size of the oil gap between the casing and the x-ray tube insert, which consequently enhances the contact of the oil with the insert for heat transfer purposes and also provides increased dimensional stability to the insert when placed within the casing.

According to still another aspect of an exemplary embodiment of the invention, the casing includes a manifold disposed within the casing. The manifold provides more efficient and even distribution of the dielectric oil within the casing about the x-ray tube insert, thereby providing more effective cooling for the x-ray tube insert. The efficiency of cooling is improved by integral splits of the available coolant to he directed to the points of priority for cooling on the insert. Traditional x-ray tube casing do not incorporate deliberate splitting and directing of cooling due to complexity of internal coolant routing.

According to still a further aspect of an exemplary embodiment of the invention, the casing includes a component for accommodating the expansion of the volume of oil during operation of the x-ray tube insert. The component is formed as a deformable bladder or bellows located within the casing and movable under the pressure exerted by the expansion of oil within the casing when heated. The bladder operates to maintain the desired pressure exerted by the dielectric oil within the casing by increasing or decreasing the volume of the interior of the casing to accommodate the pressure changes resulting from temperature changes to the dielectric oil in the casing.

In another exemplary embodiment of the invention, the invention is an x-ray tube casing for an x-ray tube insert, the casing including a housing adapted to receive at least a portion of the x-ray tube insert therein, and a heat exchanger including a number of fluid flow passages, the heat exchanger formed on an exterior surface of the housing, wherein the housing and the heat exchanger are formed in an additive manufacturing process.

In still another exemplary embodiment of the invention, an x-ray tube includes an x-ray tube insert including a frame defining an enclosure, a cathode assembly disposed in the enclosure and an anode assembly disposed in the enclosure spaced from the cathode assembly and an x-ray tube casing including a housing formed in an additive manufacturing process and within which the x-ray tube insert is placed, the housing including a side wall and a heat exchanger formed on an exterior of the side wall.

In an exemplary embodiment of a method of the invention, a method for exchanging heat from a cooling fluid disposed within an x-ray tube includes the steps of additively manufacturing an x-ray tube casing including a housing having a heat exchanger formed on an exterior surface of a side wall of the housing, the heat exchanger including at least one passage in communication with an interior space defined by the housing, placing an x-ray tube insert within the interior space defined by the central frame, placing an amount of cooling fluid in the interior space between the x-ray tube insert and the housing and directing a flow of the cooling fluid through the at least one passage to exchange heat from the cooling fluid.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION OF THE DISCLOSURE

In the following detailed description, reference is made to the accompanying drawings that form a part hereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Figure 1:
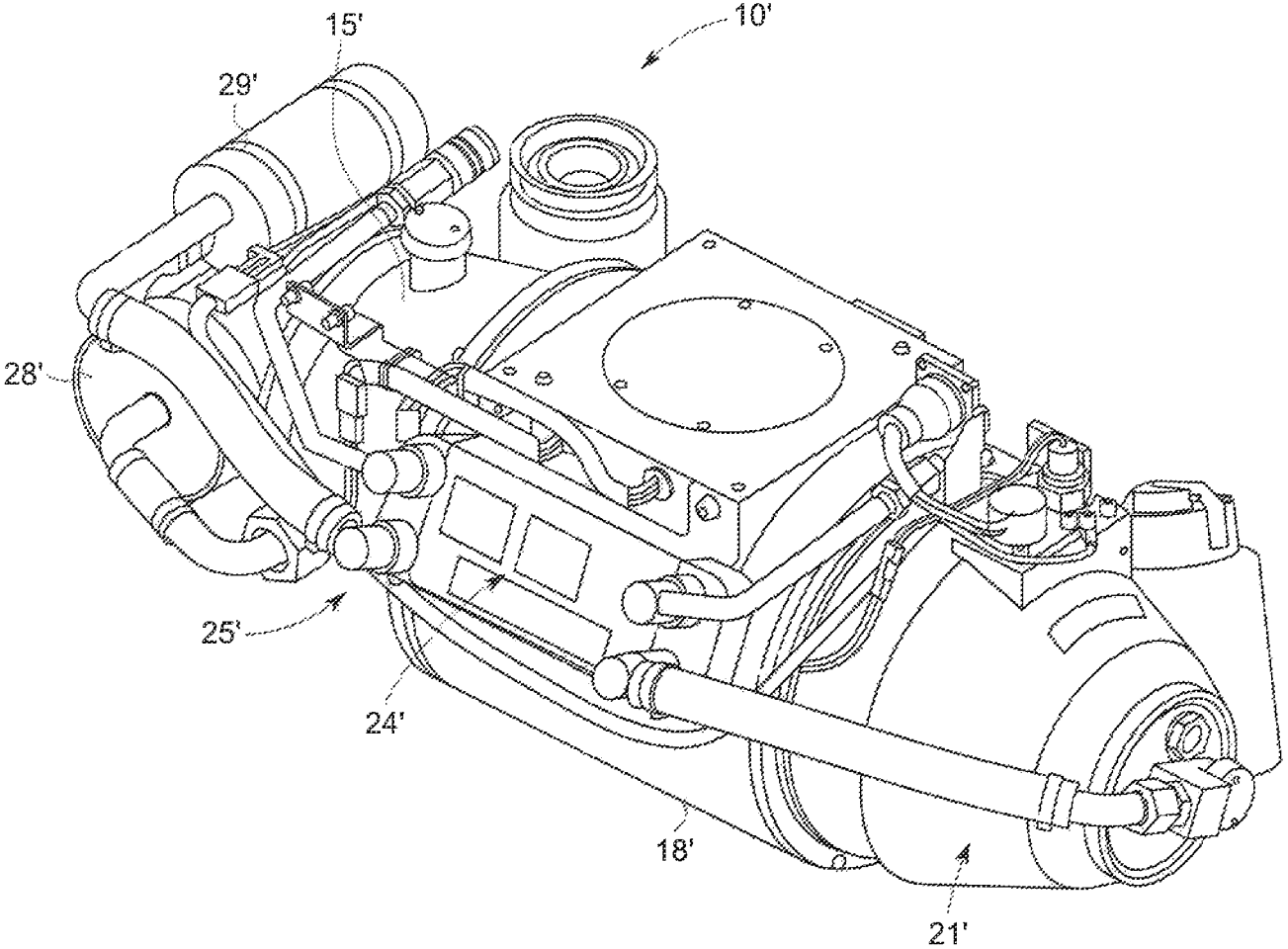
PRIOR ART FIG. 1
FIG. 1 is an isometric view of a prior art x-ray tube casing.
Figure 2:
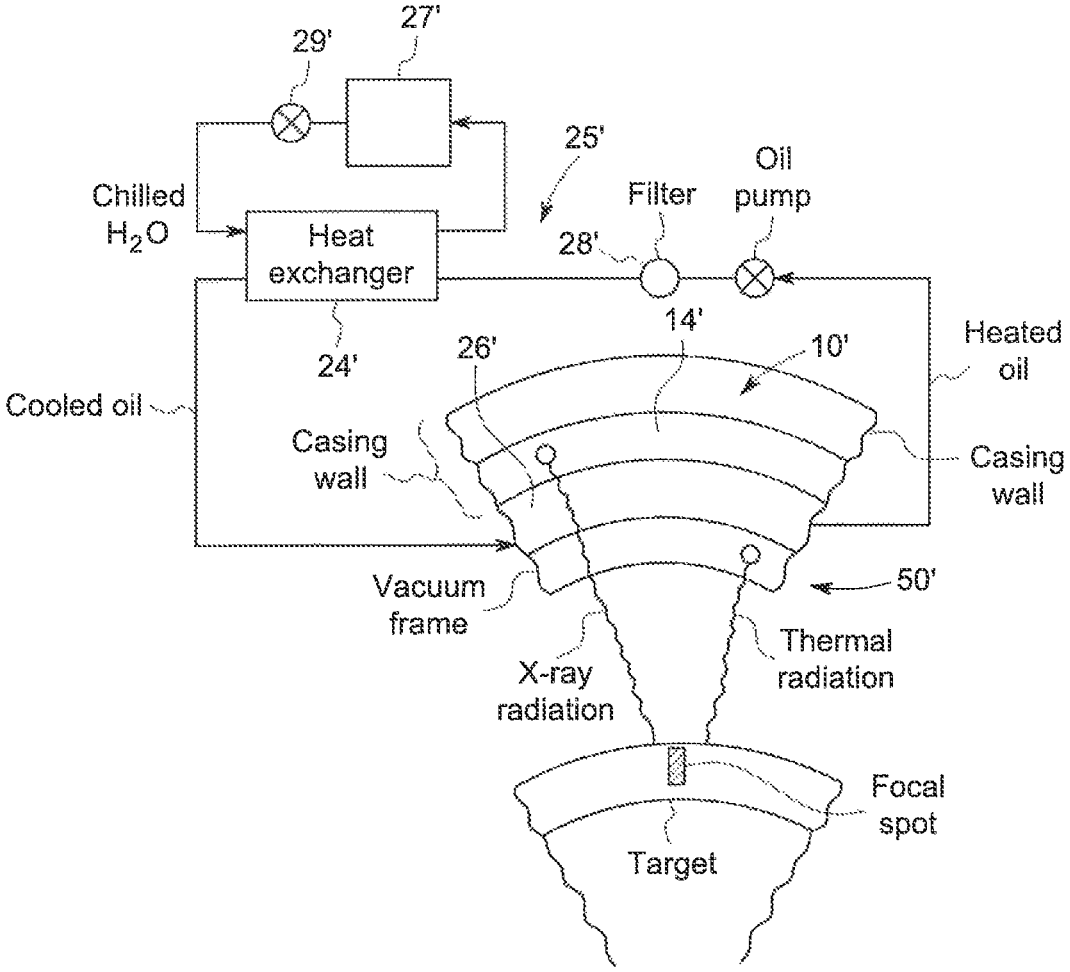
PRIOR ART FIG. 2
FIG. 2 is a schematic view of the prior art x-ray casing of FIG. 1.
Figure 3:
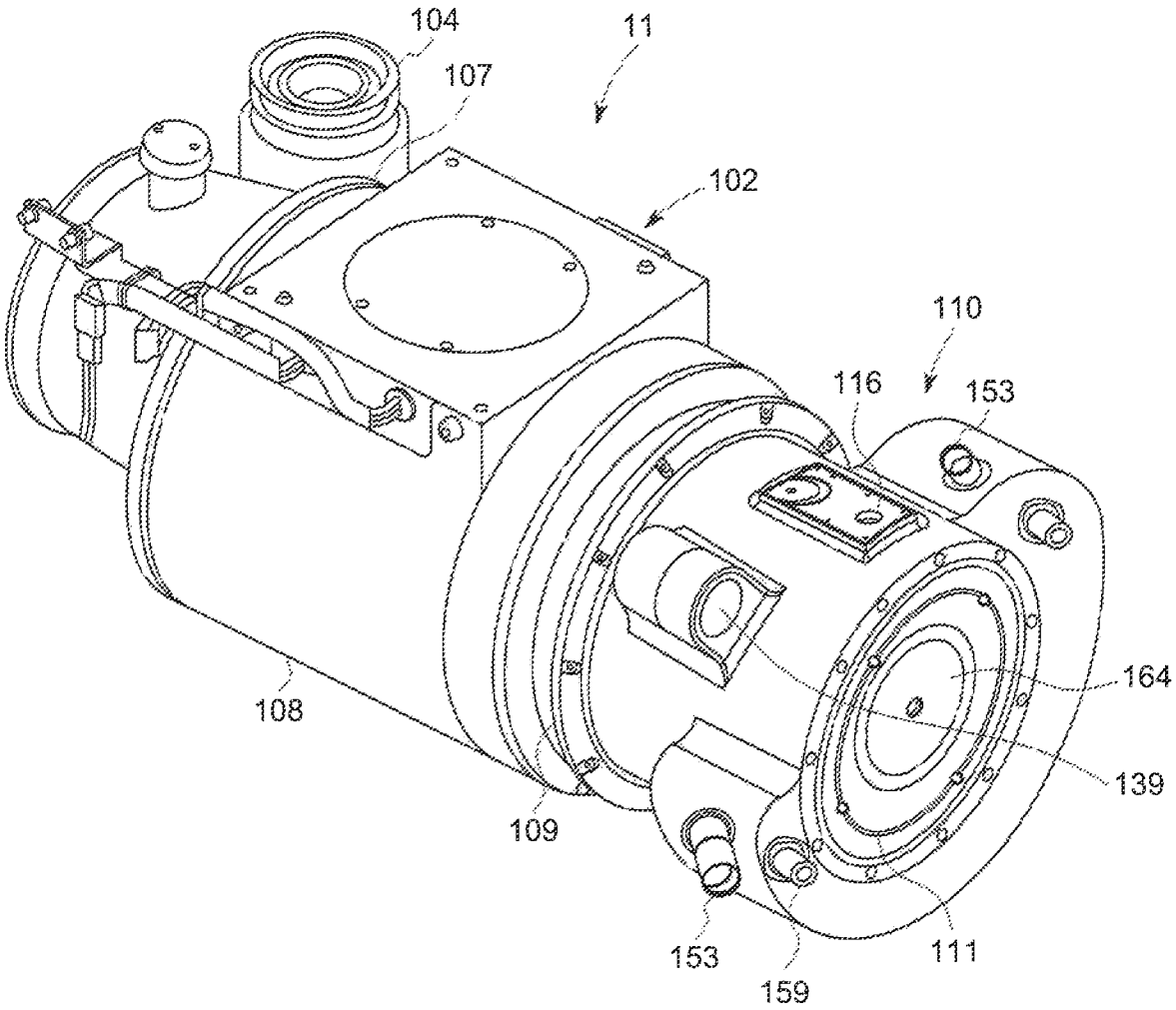
FIG. 3 is an isometric view of an x-ray tube casing in accordance with an exemplary embodiment of the invention.
Figure 4:
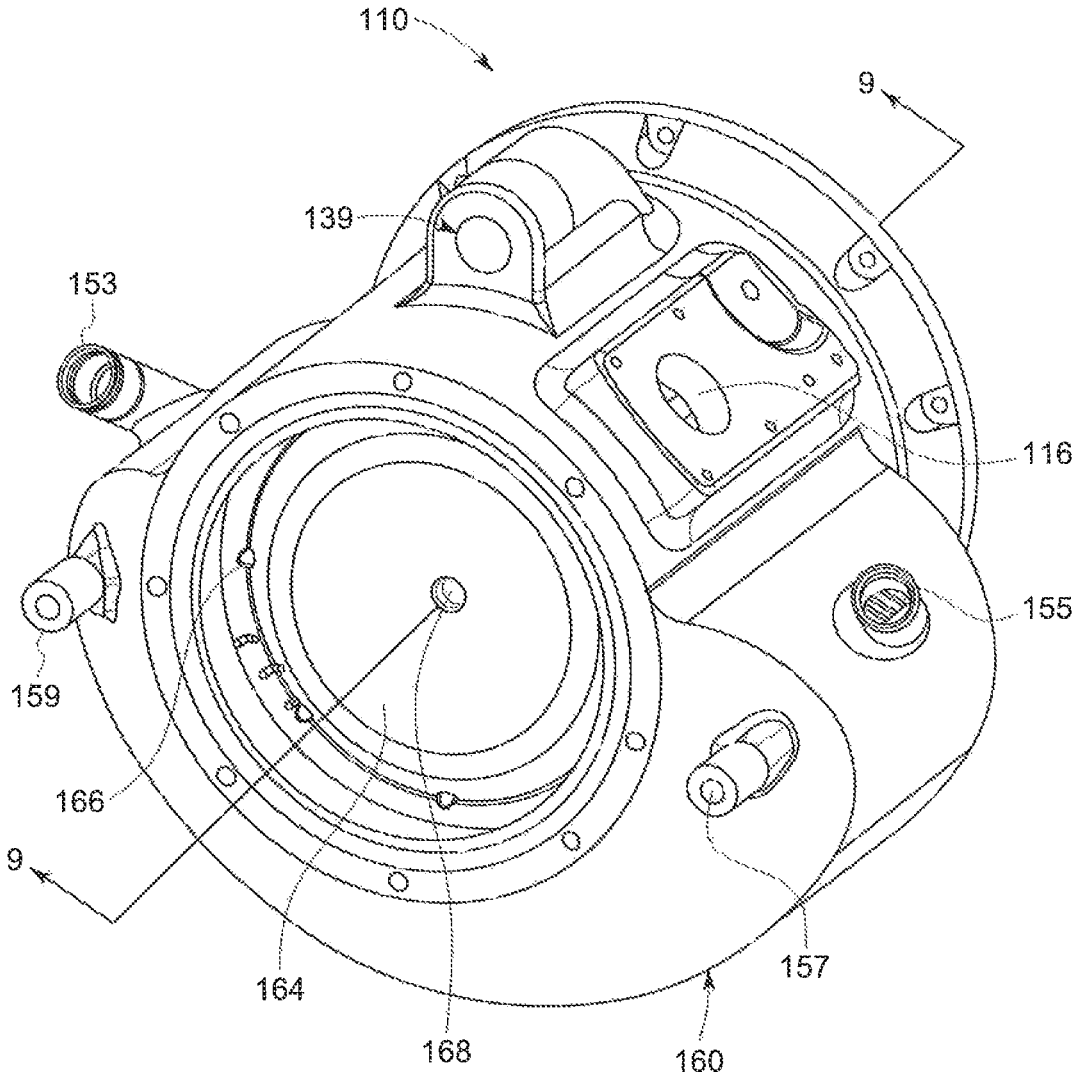
FIG. 4 is an isometric view of the x-ray end casing in accordance with an exemplary embodiment of the invention.

Looking now at FIGS. 3 and 4, in the illustrated exemplary embodiment the x-ray tube insert (not shown) is disposed within an x-ray tube casing 100 to form the x-ray tube 11. The casing 100 includes a hollow housing or body 102, a high voltage (HV) connector/end cap 104 secured to the housing 102 adjacent the cathode assembly (not shown) and a cover plate 106 (FIG. 10) secured to the housing 102 opposite the HV connector 104. The hollow housing 102 is formed of a generally cylindrical mid casing 108 that is open at each end 107, 109 and within which the cathode assembly and anode (not shown) of the x-ray tube 11 are disposed. The housing 102 additionally includes a generally cylindrical end casing 110 mounted to and/or disposed around one open end 109 of the mid casing 108 which itself includes an open end 111 opposite the mid casing 108 and which encloses the shaft 61 and bearing assembly 63 (FIG. 9) of the x-ray source (not shown) that extend outwardly from the mid casing 108.

Referring now to the exemplary embodiments illustrated in FIGS. 3-4, the end casing 110 additionally encloses a stator basket (not shown) disposed within the interior of the end casing 110 around the shaft 61 and bearing assembly 63. The stator basket is operably connected to a voltage source (not shown) via a suitable connector (not shown) extending through an aperture 116 in the end casing 110 in order to supply current to the stator basket to enable the basket to interact with and spin the shaft 61 when the x-ray tube insert is operated.

Figure 9:
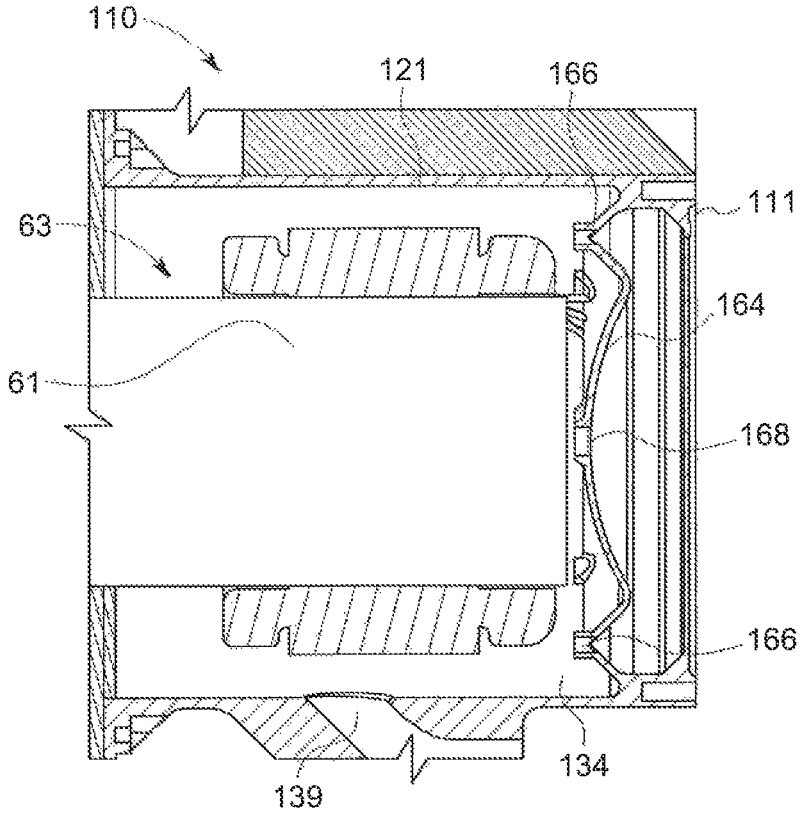
FIG. 9 is a cross-sectional view along line 9-9 of FIG. 4.
Figure 10:
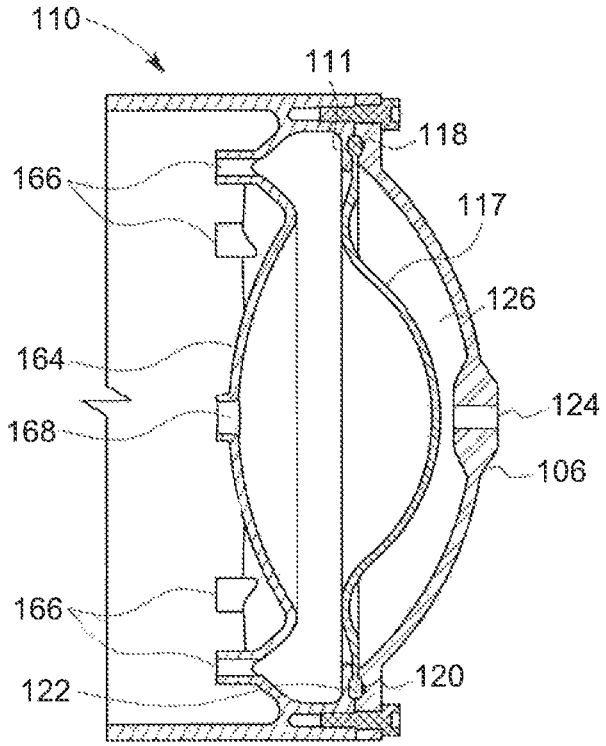
FIG. 10 is a partially broken away cross-sectional view of the x-ray casing of FIG. 9.

Looking now at the exemplary embodiment illustrated in FIGS. 9-10, the open end 111 of the end casing 110 is enclosed by the cover plate 106 that engages a flexible bladder or fluid expansion bellows 117 between the cover plate 106 and the open end 111 of the end casing 110. The bellows 117 is formed of a suitable material, such as a rubber bladder, and extends over the entire open end 111 of the end casing 110. In the exemplary illustrated embodiment, the bellows 117 is generally circular in shape and includes a curved cross-section to provide the bellows 117 with the capacity to expand and contract upon differential pressures exerted on the bellows 117. To maintain a fluid-tight seal in conjunction with the cover plate 106 and the end casing 110, the bellows 117 includes a peripheral cylindrical bead 118 formed around the entire periphery of the bellows 117. The bead 118 is disposed within and compressed by aligned complementary recesses 120, 122 formed in the cover plate 106 and end casing 110, respectively, to provide a fluid tight seal, while also allowing the bellows 117 to expand and contract between the cover plate 106 and the end casing 110. To accommodate for the expansion and contraction, the cover plate 106 includes a vent 124 that allows air to enter and exit the space 126 defined between the bellows 117 and the cover plate 106.

Opposite the cover plate 106, the end casing 110 is secured to the mid casing 108 in a suitable manner to seal the end casing 110 to the mid casing 108. With the end casing 110 thus sealed, it is possible to fill the end casing 110 with an amount of dielectric oil 136, such as via sealable oil fill port 139, in order to provide cooling to the operation of the shaft 61 and beating assembly 63.

Figure 5:
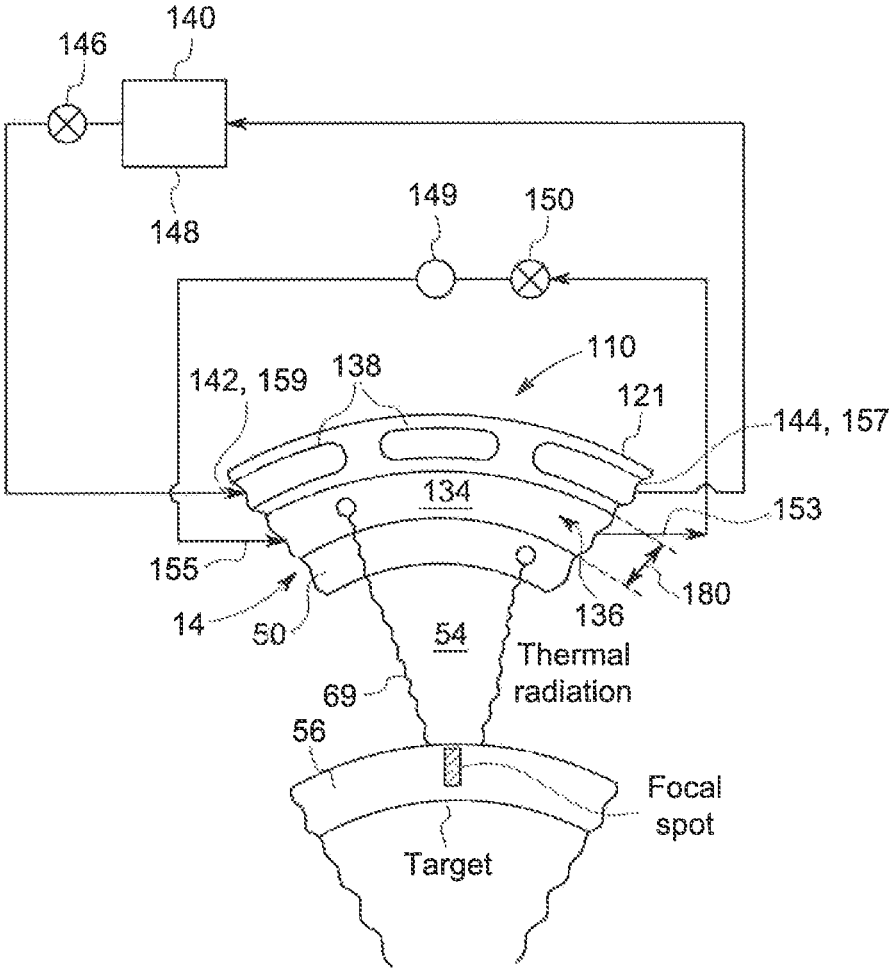
FIG. 5 a schematic view of the x-ray tube and x-ray casing of FIG. 3.

As illustrated in the exemplary embodiment of FIG. 5, when assembled with the connector/end cap 104 and cover plate 106, the housing 102 defines an interior space (not shown) within which the portion of the x-ray tube insert including the cathode assembly and anode/target 56 is located. The mid casing 108 and end casing 110 of the housing 102 effectively form a fluid-tight enclosure around the interior space 134 in order to retain an amount of a cooling fluid/dielectric oil 136 in the interior space 134 between the x-ray tube insert/source 14 and the housing 102. The oil 136 is introduced through a sealable fill port 139 formed in the end casing 110 and functions to cool the internal components of the x-ray tube insert 14 by flowing around and thermally contacting the frame 50 of the x-ray tube/source 14 and drawing the heat generated by the operation of the x-ray tube insert 14 out of the x-ray tube insert 14 via contact with the frame 50.

Referring now to FIGS. 4-8, in order to remove the heat from the insert cooling fluid/dielectric; oil 136, the casing 100, or a component part or parts of the casing 100, e.g. the entire housing 102, the mid casing 108, the end casing 110, the end cap 104, or any combination thereof can be formed to include a passage(s) 138 or channels 152,154 therein to enable a cooling fluid 140 to pass through a side wall 121 of the casing 100 or component part thereof. This provides the casing 100 with an integral cooling functionality to enable the casing 100 to effectively remove the heat generated by the operation of the shaft 61 and bearing assembly 63.

In one exemplary embodiment schematically illustrated in FIG. 5, the passage(s) 138 can be formed as a continuous passage 138 throughout the side wall 121 of the housing 102 or portion thereof, or can be formed as individual passages 138 each extending through the side wall 121. The passage (s) 138 are each connected to a source of a cooling fluid 140, such as water, a water/glycol mixture or any other suitable fluid having desirable heat exchange properties, that is directed into the passages 138 to flow from an water inlet header 142, 157 of each passage 138 to a water outlet header 144, 159. The heat transfer properties of water are significantly superior to dielectric oil, so the total heat transfer is determined by the heat transfer from the vacuum vessel wall/frame 50 to the oil 136. Each passage 138 is formed within the side wall 121 to retain a thickness of the side wall 121 between the interior space 134 of the housing 102 and the passages 138 that is sufficient to enable the cooling fluid 140 flowing through the passages 138 to thermally contact the oil 136 located within the interior space 134, but without enabling the oil 136 and fluid 140 to come into direct contact with one another. This provides effective heat exchange due to the large surface area of the side wall 121 that is in direct contact with the dielectric oil 136 flowing in the space or gap 180 between the x-ray tube insert 14 and the side wall 121. The cooling fluid 140 can be introduced into the inlet end 142 of the passages 138 by a pump 146 connected to a chilled reservoir 148 of the cooling fluid 140 that operates to cool the heated cooling fluid 140 exiting the passages 138 in the housing 102. The operation of the pump 146 can be controlled to direct the cooling fluid 140 into the passages 138 at a rate commensurate with the operation of the x-ray tube 14 in order to provide the proper cooling to the dielectric oil 136.

The dielectric oil 136 can be allowed to come into thermal contact with the cooling fluid 140 in passage(s) 138 solely by convection, where the heat absorbed by the oil 136 adjacent the frame 50 causes the heated oil 136 to move outwardly from the frame 50 where it is heated through the interior space 134 towards the housing 102. Upon reaching the housing 102, the heated oil 136 thermally contacts the cooling fluid 140 flowing through the passage(s) 138 in order to cool the oil 136, which subsequently flows back towards the flame 50 to displace heated oil 136 near the frame 50. This embodiment is applicable for lower average power x-ray tubes 14 employed on surgical C-arms and further reduces cost, size and weight due to elimination of the oil pump 150.

Alternatively, the oil 136 can be circulated into thermal contact with the cooling fluid 140 by a pump 150 that withdraws heated oil 136 from the interior space 134 via suitable conduit connected to an outlet header 153 and through an oil filter 149 prior to re-introduction of the oil 136 from the filet 149 via a suitable conduit into the interior space 134 of the housing 102 through an inlet header 155. In this manner the oil 136 is drawn into thermal contact with the cooling fluid 140 flowing through the passage(s) 138 in order to cool the oil 136.

With particular regard to the illustrated exemplary embodiment in FIGS. 4 and 6-8, the casing 100, or a component part of the casing 100, such as the entire housing 102, the mid casing, the end casing 110, or any combination thereof can be formed to have internal countercurrent channels 152,154 separated by plates 151 and extending through the side wall 121 of the end casing 110/component part of the casing 100 as an alternative to the passages 138. As illustrated with respect to the end casing 110, the channels 152,154 and plates 151 are located within an integral heat exchanger 160 formed directly on and integrally with the exterior of the side wall 121 of the end casing 110.

Figure 6:
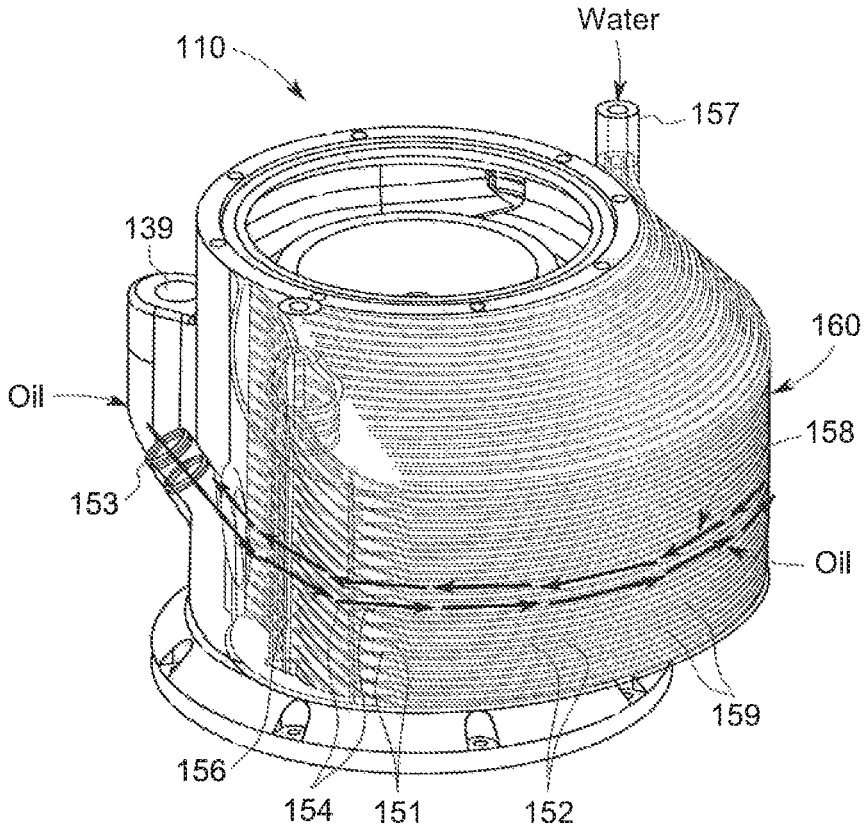
FIG. 6 is a partially broken away, isometric view of the x-ray tube end casing of FIG. 4.
Figure 7:
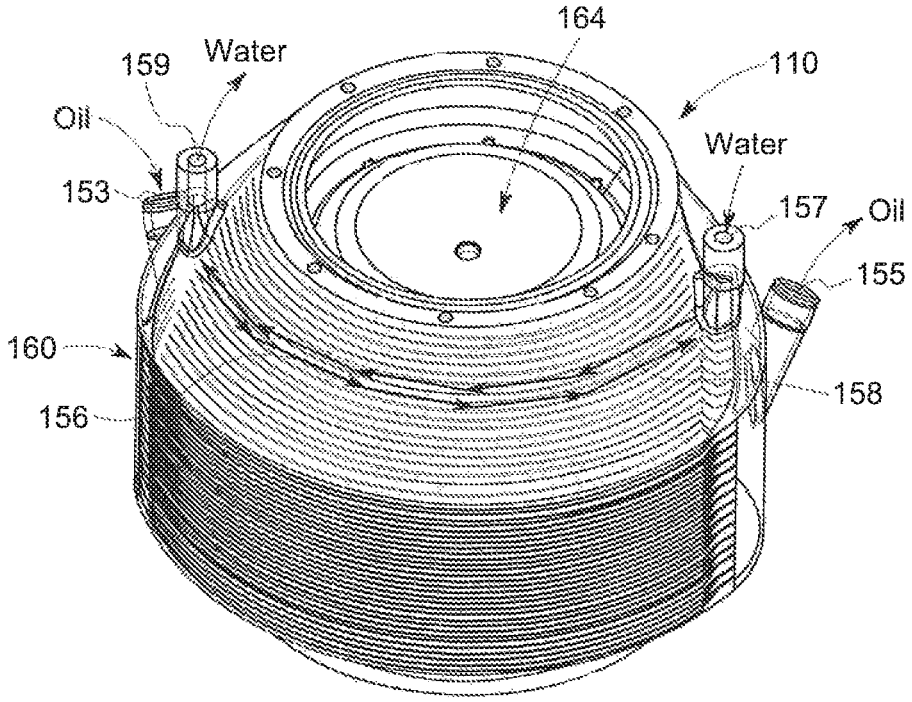
FIG. 7 is a partially broken away, isometric view of the x-ray tube end casing of FIG. 4.
Figure 8:
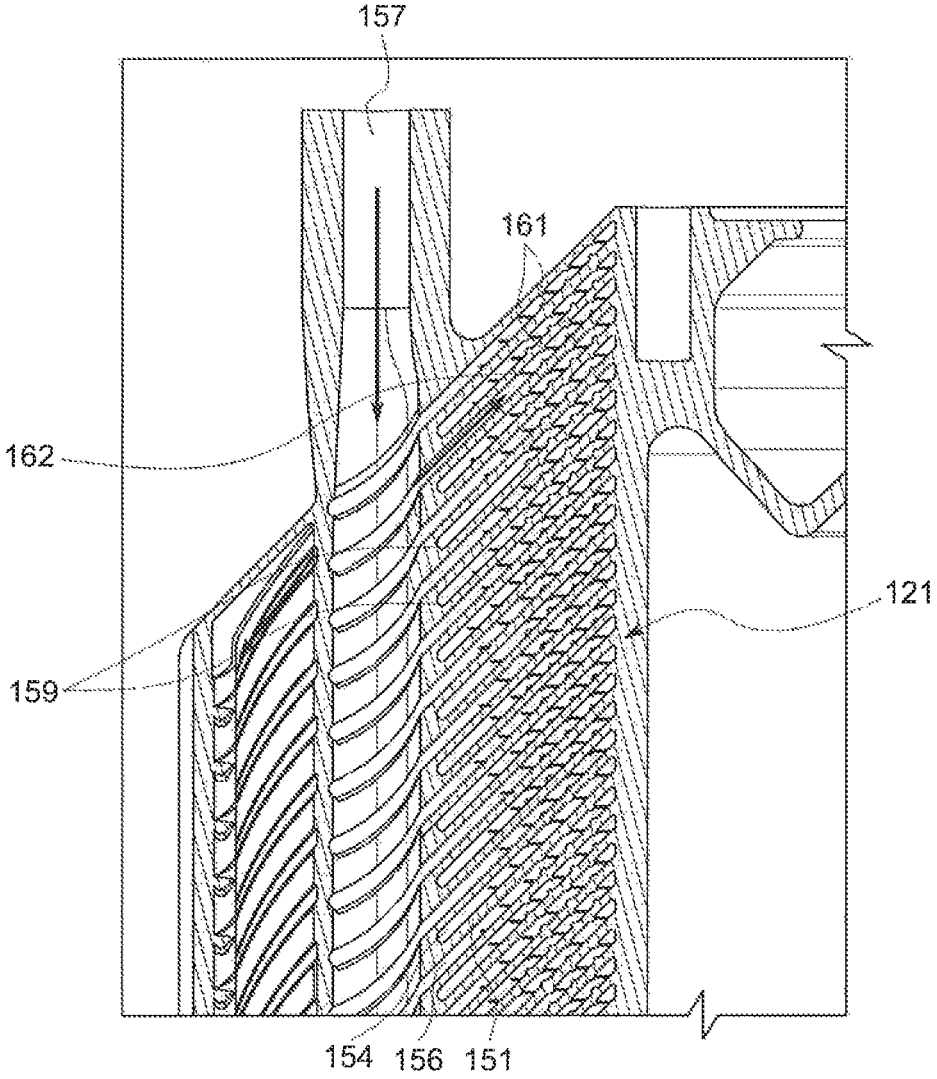
FIG. 8 is a partially broken away cross-sectional view of the x-ray tube end casing of FIG. 4.
Figure 11:
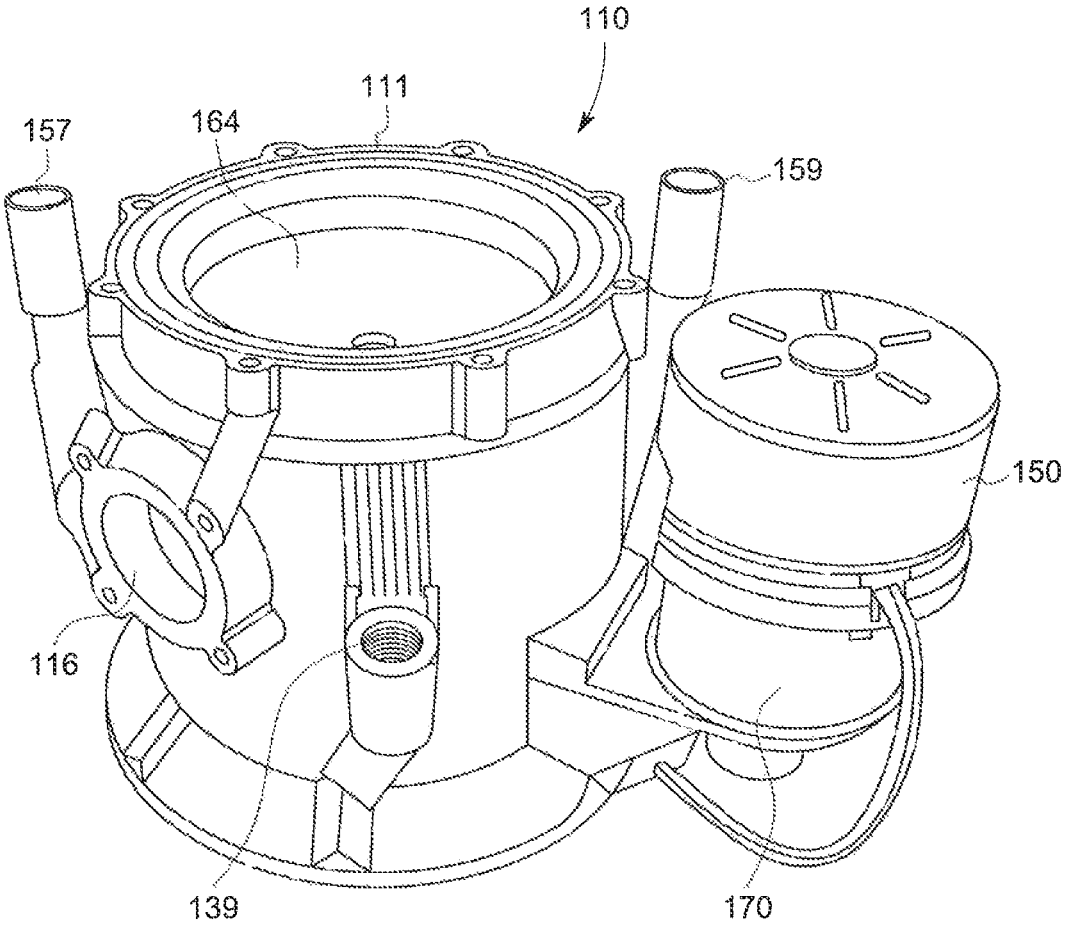
FIG. 11 is an isometric view of an x-ray tube casing in accordance with another exemplary embodiment of the invention.

Within the heat exchanger 160, as shown in the illustrated exemplary embodiment of FIGS. 6 and 7, the channels 152 are connected between an oil inlet header 153 and an oil outlet header 155 to provide a first flow path 156 for the heated dielectric oil 136. Oil 136 is drawn from the outlet header 155 via suitable conduit connected to a pump 150, which can be disposed directly in a pump chamber or housing 170 on the end casing 110 (FIGS. 11-12), that is operable to withdraw heated oil 136 from the interior 134 of the end casing 110. Additionally, the end casing 110/heat exchanger 160 can he formed to additionally integrally connect the oil outlet header 155 with the manifold 164 for directing the cooled oil 136 back into the interior 134 of the casing 100. In the exemplary embodiment illustrated in FIGS. 11 and 12, the housing 170 is formed integrally with the remainder of the end casing 110, such as in the additive manufacturing process, and includes an oil inlet and an oil outlet formed therein. In this manner, the oil inlet port 153 and oil outlet port 155 are eliminated from the end casing 110, thereby further reducing the number of hoses and other connections required for operation of the tube 11.

Figure 12:
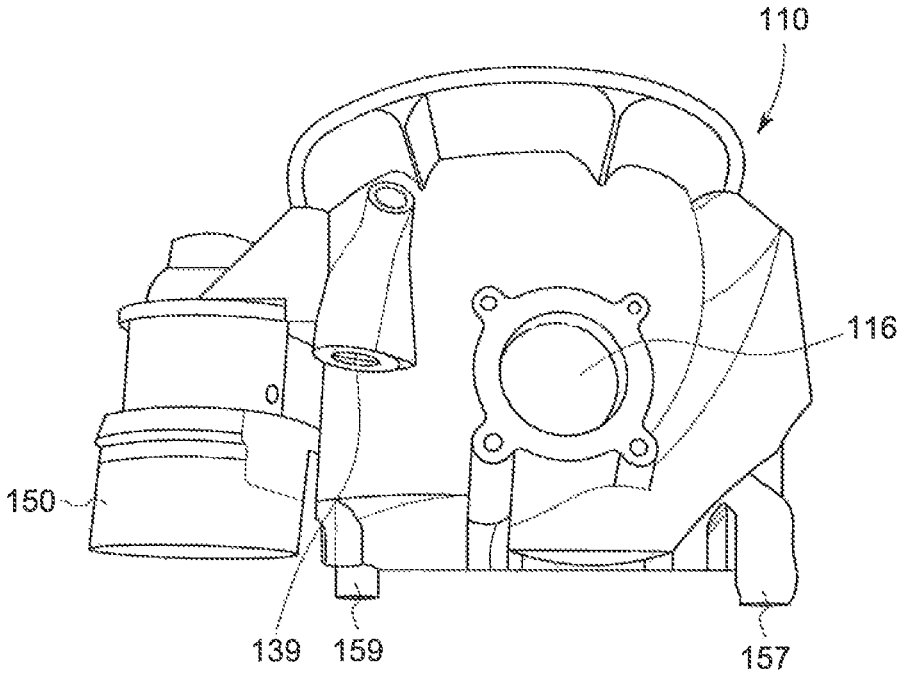
FIG. 12 is a top plan view of the x-ray tube casing of FIG. 11.

Further, as shown in the illustrated exemplary embodiment of FIGS. 12-13, the channels 154 are connected between a water inlet header 157 and a water outlet header 159 to provide a second, countercurrent flow path 158 for the cooling fluid/water 140 that is directed into and out of the channels 154 from a reservoir 148 by suitable conduits connected to a pump 146. While any configuration for the channels 152,154 is contemplated as being within the scope of the invention, as shown in the exemplary embodiment of FIG. 8, either or both of the channels 152,154 can be manufactured as a number of conduits 161 separated by fins 162 in order to increase the thermal contact and consequent heat transfer between the oil 136 and cooling fluid 140 flowing through the channels 152,154. These channels 152, 154 can also be manufactured to have an angular slope in order to provide additional structural integrity to the channels 152,154. Additionally, the number of conduits 161 formed in the respective channels 152 and 154 can be formed to be the same or different from one another in order to achieve the desired heat exchange within the heat exchanger 160 including the channels 152,154.

Referring now to the exemplary illustrated embodiment of FIGS. 9 and 10, from the oil outlet header 155 the cooled dielectric oil 136 is directed into a fluid distribution manifold 164 disposed within the end casing 110 adjacent the bellows 117, and in the illustrated exemplary embodiment integrally formed with the end casing 110. The manifold 164 extends across the interior of the end casing 110 and includes a number of spaced nozzles or orifices 166,168 extending therethrough. The orifices 166 are located around the periphery of the manifold 164 and serve to direct an amount of the cooled dielectric oil 136 into the interior 134 of the end casing 110, where the oil 136 can thermally contact the frame 50 of the x-ray tube insert 14. The orifice 168 is disposed generally centrally on the manifold 164 in alignment with the bearing assembly 63 in order to direct an amount of the cooled dielectric oil 136 into the shaft 61 and bearing assembly 63.

As the passages 138 or channels 152,154 are formed directly within the side wall 121 of the casing 100, manufacturing processes with tight tolerance controls are necessary to form the casing 100. In order to reduce costs, weight and to provide the intricately formed side wall 121 with the internal passages 138 or channels 152,154 as described, the casing 100/housing 102/mid casing 108/end casing 110 may be manufactured or formed, at least in part or entirely, via one or more additive manufacturing techniques or processes, thus providing for greater accuracy and/or more intricate details within the casing 100/housing 102/mid casing 108/end casing 110 than previously producible by conventional manufacturing processes. As used herein, the terms "additively manufactured" or "additive manufacturing techniques or processes" include but are not limited to various known 3D printing manufacturing methods such as Extrusion Deposition, Wire, Granular Materials Binding, Powder Bed and Inkjet Head 3D Printing, Lamination and Photo-polymerization.

In one embodiment, the additive manufacturing process of Direct Metal Laser Melting (DMLM) is an exemplary method of manufacturing the casing 100/housing 102/mid casing 108/end casing 110 or components thereof described herein. DMLM is a known manufacturing process that fabricates metal components using three-dimensional information, for example a three-dimensional computer model of the casing 100/housing 102/mid casing 108/end casing 110. The three-dimensional information is converted into a plurality of slices where each slice defines a cross section of the component for a predetermined height of the slice. The casing 100/housing 102/mid casing 108/end casing 110, such as the side wall 121 of the end casing 110, is then "built-up" slice by slice, or layer by layer, until finished. Each layer of the casing 100/housing 102/mid casing 108/end easing 110 is formed by melting or fusing layers of metallic powders, such as aluminum powders, or other materials/metals, such as stainless steel, to one another using a laser.

Although the methods of manufacturing the casing 100/housing 102/mid casing 108/end casing 110 including the internal passages 138 or channels 152,154 have been described herein using DMLM as an exemplary method, those skilled in the art of manufacturing will recognize that any other suitable rapid manufacturing methods using layer-by-layer construction or additive fabrication can also be used, These alternative rapid manufacturing methods include, but not limited to, Direct Metal Laser Sintering (DMLS), Selective Laser Sintering (SLS), 3D printing, such as by inkjets and laserjets, Sterolithography (SLS), Direct Selective Laser Sintering (DSLS), Electron Beam Sintering (EBS), Electron Beam Melting (EBM), Laser Engineered Net Shaping (LENS), Laser Net Shape Manufacturing (LNSM) electron beam powder bed fusion and Direct Metal Deposition (DMD).

With the precise manufacturing tolerances provided through the use of the additive manufacturing process for the construction of the casing 100, the passages 138 or channels 152,154 can be formed with a width and/or height of between 1.0 mm-2.0 mm, and in other embodiments between 1.4 mm and 1.8 mm, within the heat exchanger 160. Further, the precise control of the overall shape of the casing 100, including the mid casing 108 and end casing 110, relative to the shape of the x-ray tube insert 14 allows for a reduction in size of the oil gap 180 between the frame 50 of the x-ray tube insert 14 and the side wall 121 of the casing 100 to significantly increase the heat transfer coefficient compared to traditional x-ray casings, which is achieved by maintaining a smaller hydraulic diameter of the oil layer/gap 160.

In addition, while the additive manufacturing process employed to construct the casing 100, e.g., the end casing 110, allows for precise manufacturing tolerances, the nature of the material(s) used in these processes results in relatively rough or uneven surfaces for the end casing 110. As a result, these uneven or rough surfaces within the passages 138 or channels 152,154 provide even further enhancement to the heat exchange properties of the heat exchanger 160 including the passages 138 or channels 152,154 due to the increased surface area within the passages 138 or channels 152,154 from the rough surfaces.

With the additive manufacturing process for the casing 100 and/or component parts thereof, such as the entire housing 102, the mid casing 108 and/or in particular the end casing 110, the incorporation of the heat exchanger 160 directly onto the end casing 110 allows for a significant reduction in the size and weight of the x-ray tube 12, including the insert 14 and the casing 100. The end casing 110 structurally incorporates a number of previously external or additional components into the end casing 110 to accomplish this, as well as to eliminate a number of connecting hoses, seals and resulting potential leak points. The end casing 110 also provides directed cooling to the insert 14 and the bearing assembly via the manifold 164 and internally accommodates for expansion of the oil 136 through the use of the bellows 117, all within the structure of the end casing 110.

As a result of this improved structure for the casing 100, and in certain exemplary illustrated embodiments the end casing 110, the smaller and lighter x-ray tube 11 provides improved angulation of the tube 11 around a patient to improve view angles and provide better treatment. In addition, the smaller footprint foe the tube x-ray tube 11 provides better access to a patient and enables lower C-arm static and dynamic loads, with resulting faster spin speeds and lower costs for the gantry.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An x-ray tube casing for an x-ray tube insert, the casing comprising:

a housing adapted to receive at least a portion of the x-ray tube insert therein;

a heat exchanger including a number of fluid flow passages, the heat exchanger formed on an exterior surface of the housing; and a fluid expansion bellows disposed within the housing.

2. The x-ray tube casing of claim 1 wherein the number of fluid flow passages include first fluid flow passages and second fluid flow passages.

3. The x-ray tube casing of claim 2 wherein first fluid flow passages and the second fluid flow passages are countercurrent to one another.

4. The x-ray tube casing of claim 2 wherein the first fluid flow passages and the second fluid flow passages have different dimensions.

5. The x-ray tube casing of claim 2 wherein one of the first or second fluid flow passages is in fluid communication with an interior space of the housing.

6. The x-ray tube casing of claim 1 further comprising a fluid distribution manifold disposed within an interior of the housing.

7. The x-ray tube casing of claim 6 wherein the manifold is integrally formed with the housing.

8. The x-ray tube casing of claim 1 wherein the housing includes an oil pump chamber formed on the exterior of the housing.

9. The x-ray tube casing of claim 8 wherein the oil pump housing is fluid communication with the number of fluid passages in the heat exchanger.

10. The x-ray tube of claim 1 wherein the bellows includes a peripheral sealing bead engaged with the housing.

11. The x-ray tube casing of claim 1 wherein the housing is formed in a direct metal laser melting additive manufacturing process.

12. The x-ray tube casing of claim 1, wherein the housing comprises:

a mid casing within which at least a part of the x-ray tube insert is disposed; and an end casing secured to the mid casing within which at least a portion of the x-ray tube insert is disposed, the end casing including the heat exchanger having a number of fluid flow passages formed on an exterior surface of the end casing.

13. An x-ray tube comprising:

an x-ray tube insert; and an x-ray tube casing including a housing formed in an additive manufacturing process and within which the x-ray tube insert is placed, the housing including a side wall and a heat exchanger formed on an exterior of the side wall;

wherein the heat exchanger comprises:

a first internal passage having an inlet and an outlet, wherein the first internal passage is not in fluid communication with an interior space defined by the housing; and a second internal passage having an inlet and an outlet, wherein the second internal passage is in fluid communication with the interior space defined by the housing.

14. The x-ray tube of claim 13 wherein the housing includes a fluid distribution manifold disposed within an interior space defined by the housing.

15. The x-ray tube of claim 13 wherein the housing includes a fluid expansion bellows disposed over one end of the housing.

16. The x-ray tube of claim 13 wherein the housing comprises:

a mid casing within which at least a part of the x-ray tube insert is disposed; and an end casing secured to the mid casing within which at least a portion of the x-ray tube insert is disposed, the end casing including the heat exchanger having a number of fluid flow passages formed on an exterior of a side wall of the end casing.

17. A method for exchanging heat from a cooling fluid disposed within an x-ray tube, the method comprising the steps of:

additively manufacturing an x-ray tube casing including a housing having a heat exchanger formed on an exterior surface of a side wall of the housing, the heat exchanger including at least one passage in communication with an interior space defined by the housing;

placing an x-ray tube insert within the interior space defined by the central frame;

placing an amount of cooling fluid in the interior space between the x-ray tube insert and the housing; and directing a flow of the cooling fluid through the at least one passage to exchange heat from the cooling fluid wherein the housing includes a fluid distribution manifold disposed within the interior of the housing.

18. The method of claim 17 further comprising the step of directing the cooling fluid to various areas of the interior of the housing through the manifold after directing the flow of cooling fluid through the at least one passage.

19. An x-ray tube casing for an x-ray tube insert, the casing comprising:

a housing adapted to receive at least a portion of the x-ray tube insert therein;

a heat exchanger including a number of fluid flow passages, the heat exchanger formed on an exterior surface of the housing;

wherein the number of fluid flow passages include first fluid flow passages and second fluid flow passages; and wherein first fluid flow passages and the second fluid flow passages are countercurrent to one another.

20. An x-ray tube casing for an x-ray tube insert, the casing comprising:

a housing adapted to receive at least a portion of the x-ray tube insert therein;

a heat exchanger including a number of fluid flow passages, the heat exchanger formed on an exterior surface of the housing; and wherein the housing comprises:

a mid casing within which at least a part of the x-ray tube insert is disposed; and an end casing secured to the mid casing within which at least a portion of the x-ray tube insert is disposed, the end casing including the heat exchanger having a number of fluid flow passages formed on an exterior surface of the end casing.

21. An x-ray tube comprising:

an x-ray tube insert; and an x-ray tube casing including a housing formed in an additive manufacturing process and within which the x-ray tube insert is placed, the housing including a side wall and a heat exchanger formed on an exterior of the side wall;

wherein the housing includes a fluid expansion bellows disposed over one end of the housing.

* * * * *